US006477794B1

(12) United States Patent
Hoffmann

(10) Patent No.: US 6,477,794 B1
(45) Date of Patent: Nov. 12, 2002

(54) PLANING DEVICE MOUNTED ON MACHINES FOR PROCESSING ICE

(75) Inventor: Heinz Hoffmann, Wesel (DE)

(73) Assignee: Toronto GmbH, Wesel (DE)

( * ) Notice: Subject to any disclaimer, the term of this patent is extended or adjusted under 35 U.S.C. 154(b) by 0 days.

(21) Appl. No.: 09/762,965

(22) PCT Filed: Jun. 19, 2000

(86) PCT No.: PCT/DE00/01931

§ 371 (c)(1),
(2), (4) Date: Feb. 15, 2001

(87) PCT Pub. No.: WO00/79060

PCT Pub. Date: Dec. 28, 2000

(30) Foreign Application Priority Data

Jun. 18, 1999 (DE) ..... 199 27 811

(51) Int. Cl.[7] ..... E01H 4/00
(52) U.S. Cl. ..... 37/219
(58) Field of Search ..... 172/781, 78, 784, 172/786, 815; 37/219, 220, 221

(56) References Cited

U.S. PATENT DOCUMENTS 2,642,679 A * 6/1953 Zamboni
2,763,939 A * 9/1956 Zamboni
3,231,991 A * 2/1966 Wandscheer et al.
3,479,755 A * 11/1969 Schropp
3,622,205 A * 11/1971 Zamboni
3,705,746 A * 12/1972 McLeod
4,125,915 A * 11/1978 Zamboni
4,208,812 A * 6/1980 Brownly
4,372,617 A 2/1983 Zamboni
4,705,320 A * 11/1987 Zamboni
4,918,844 A * 4/1990 Marsh

FOREIGN PATENT DOCUMENTS

DE 36 08 960 9/1987

* cited by examiner

*Primary Examiner*—Victor Batson
(74) *Attorney, Agent, or Firm*—Collard & Roe, P.C.

(57) ABSTRACT

The invention relates to a planing device mounted on machines for processing ice. The inventive device is used in the area of the ice surface located close to the barrier and comprises a blade which is mounted with the carrier thereof on the lateral wall of the planing side that is provided on the machine. The planing device rests with an edge on the ice surface. The invention is characterized in that the blade can be moved from a lifted non-operating position into the working position by means of a driving mechanism.

11 Claims, 4 Drawing Sheets

PLANING DEVICE MOUNTED ON MACHINES FOR PROCESSING ICE

CROSS REFERENCE TO RELATED APPLICATIONS

Applicants claim priority under 35 U.S.C. §119 of German Application No. 199 27 811.3 filed Jun. 18, 1999 Applicants also claim priority under 35 U.S.C. §120 of PCT/DE00/01931 filed Jun. 19, 2000. The international application under PCT article 21 (2) was not published in English.

The invention relates to a planing device that is mounted on machines for processing ice, for use in the area of the surface of the ice located close to the boards. Said device comprises a blade which is mounted with its carrier on the left side of the machine, preferably on the side wall of the planer carriage provided on the machine, said planer carriage resting on the surface of the ice with its skids.

Snow (ice abrasions) accumulates along the edge of the ice facing the boards during public skating hours and when ice hockey games are played, such accumulations of snow being caused when the skaters or players are braking. Such snow is only inadequately removed by the rotating belt-type broom that is mounted on most ice processing machines. Especially when snow accumulates in large amounts, the snow starts to thaw, which causes a layer of ice to grow below, against which the rotating belt-type broom is powerless. Such a layer of ice, which rises toward the boards, cannot be reached by the planing device of the ice machine because the outer edge of the planing carriage is formed by the skid of the carriage, and the planing blade starts only within the skid of the carriage. This type of arrangement is necessarily required for reasons of ice processing. The growing ice edge is annoying to ice hokey players (when playing the puck against the boards). Said edge is very troublesome also during the ice processing operation. When the planing carriage is driven close to the boards, the skid of the carrier slides on said grown ice edge. This causes the entire carrier to be lifted on one side, which compounds the problem on the side of the boards and causes a deepening to be formed on the side of the planing device facing away from boards. If the grown ice edge is not regularly removed, the ice continues to grow more and more in the direction of the boards across the entire width of the planing device.

The abrasion problem is less serious along the curves of the boards; however, it is known from past experience that the thickness of the entire layer of ice increases there as well due to the fact that water is applied on account of the centrifugal force. The edge of the blade of the planer, however, conditioned by the radius, cannot come closer to the boards in the curve of the latter than up to 200 to 250 mm.

At the gate where the ice processing machine enters and exits, the ice quickly grows there as well after the machine has left the area of the ice field unless residues of snow and water have been removed 100% by hand. If such undesirable thick areas of ice are not regularly removed by planing, the ice continues to grow from the boards to the center in increasingly thicker layers. This impairs not only the quality of the ice but causes unnecessary energy costs as well.

The areas where ice accumulated have been removed by planing until now by the employing the following methods:

(1) A metal frame with a planing blade having a length of about 30 cm is screwed to the left outer side of the planing carriage, and the area of the boards is planed with said planing blade. Using such a planing device is time-consuming and difficult.

(2) A revolving blade driven by a battery or a gasoline engine is mounted under a device similar to a lawn mower and guided by hand along the boards and across the other areas of the ice that need to be planed.

(3) The most comfortable solution available until now is a planing aggregate with a revolving blade that is mounted in a foldable manner on the planing carriage. Before the areas along the boards are planed, said aggregate is folded down into the operating position by hand, and then folded up again after it has been used.

All of said methods require one or several planing drives and, after the planing work has been completed, leave the snow in the area of the boards behind. This then requires subsequently several drives with the broom for sweeping the area of the boards until the edge of the ice facing the boards is actually free from snow and clean over the entire length of the edge. Employing such methods during normal ice processing periods, which are short, is completely impossible in conjunction with the devices employed according to items 1 and 2 above. With the method according to item 3, planing of the areas of the boards required the operator to leave the driver's seat two times, and to carry out at least two additional drives along the boards as well.

Therefore, the invention is based on the problem of designing a planing device of the type specified above in such a way that the edge of the ice can be continually exactly processed along the barrier (boards) of the playing field without additional driving and assembly expenditure.

Said problem of the invention is solved according to the feature of the characterizing part of claim 1. Further advantageous forms of embodiment of the invention are the objects of the depending claims.

A blade that is set inclined inwards, and which can be extended and lowered, is mounted, for example on the left side wall of the planing carriage. Said blade can be operated from the seat of the driver without additional expenditure and keeps the entire outer rounding of the edge of the ice always at exactly right angles in relation to the boards. The term "keeps" is intentionally selected because during normal applications, no planing is actually taking place in most cases, but the blade only scratches away the loose snow that accumulated along the edge of the boards. By setting the planer at an angle, the latter guides the loose snow below the carrier to the conveyor, which is an integral component of the ice processing machine. Behind the planer for the board areas, the surface of the ice extending at a right angle relative to the boards is smooth and free of snow in a plane coinciding with the main blade.

If, under special circumstances, for example after a skating period in which the ice has been used by particularly great numbers of skaters, or after the outer skating track has not been treated a number of times, real planing of the edges of the area of the boards is required. This is accomplished by simply operating the planer for the areas of the boards on the outer driving track from the seat of the driver in the same manner without any additional expenditure, and with the same result as obtained when the "snow is just scratched away" in conventional operations.

A preferred embodiment of the invention, which is claimed mainly in the dependent claims as being essential to the invention, is explained in greater detail in the following with the help of drawings, in which:

Figure 1:
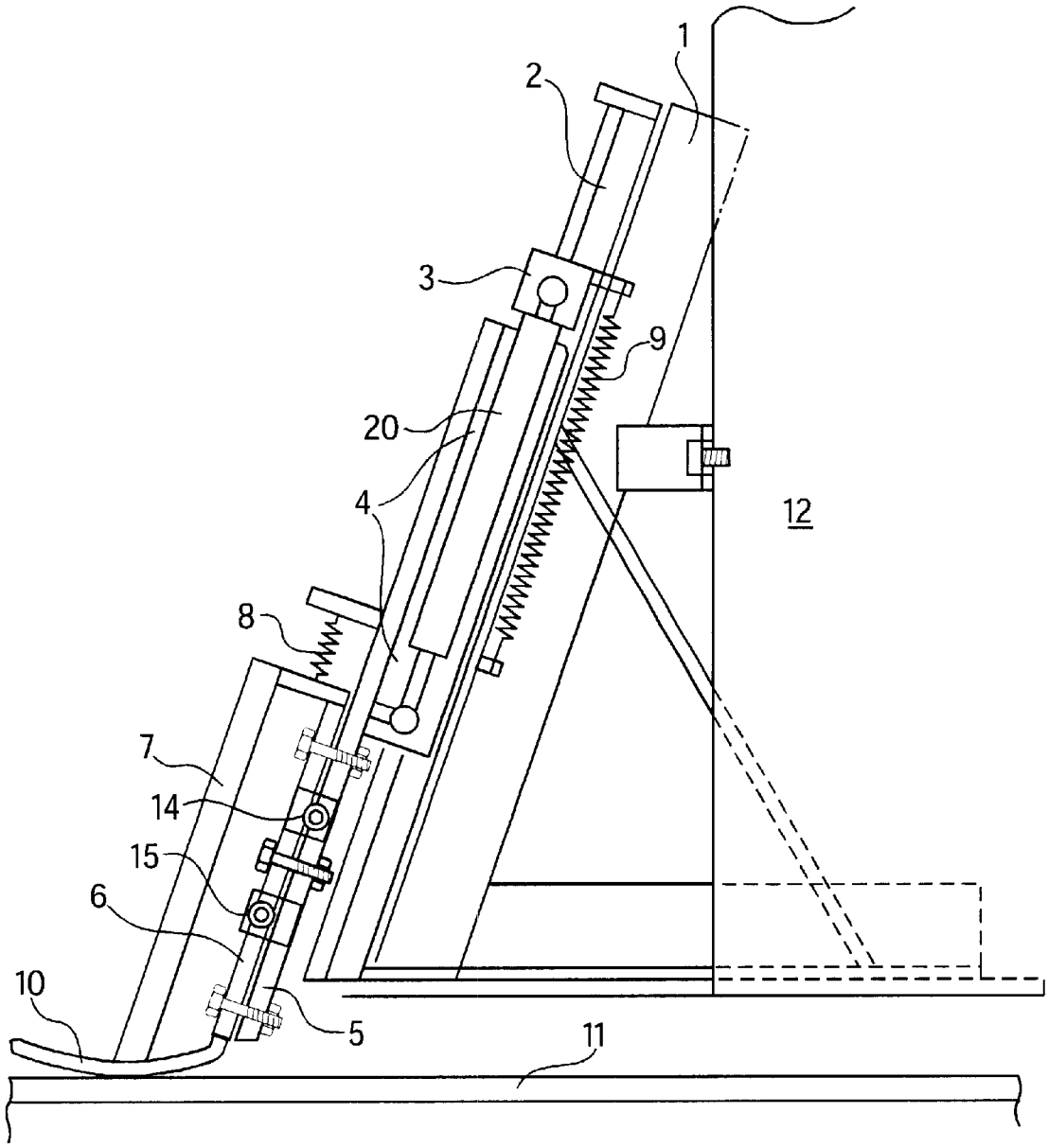
FIG. 1 is a top view of the planing device.
Figure 2:
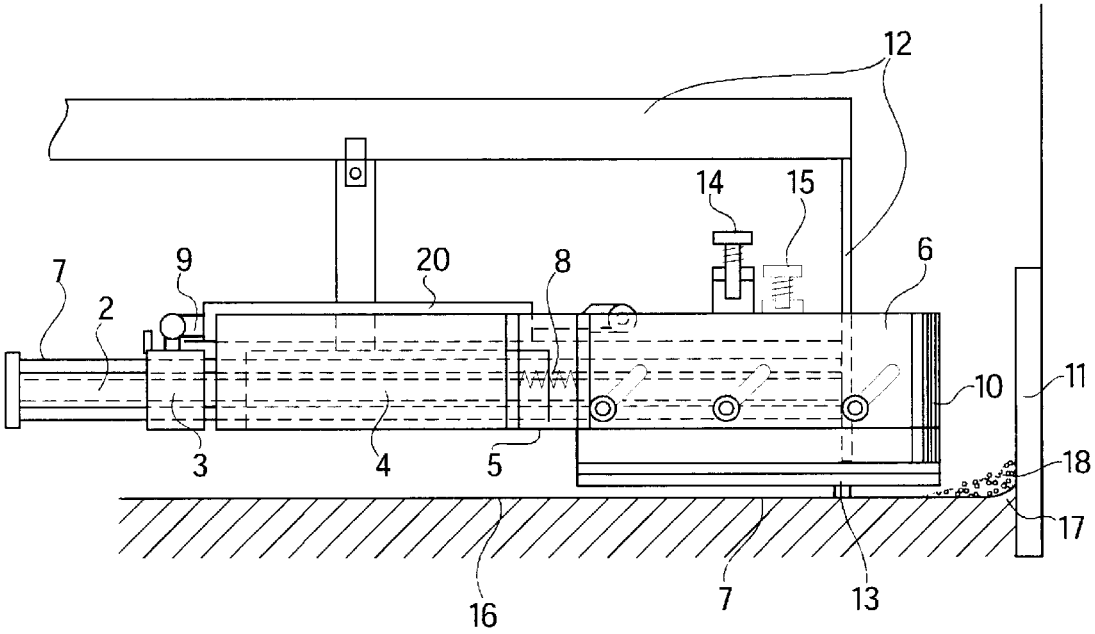
FIG. 2 is a front view of the planing device without having contact with the boards.
Figure 3:
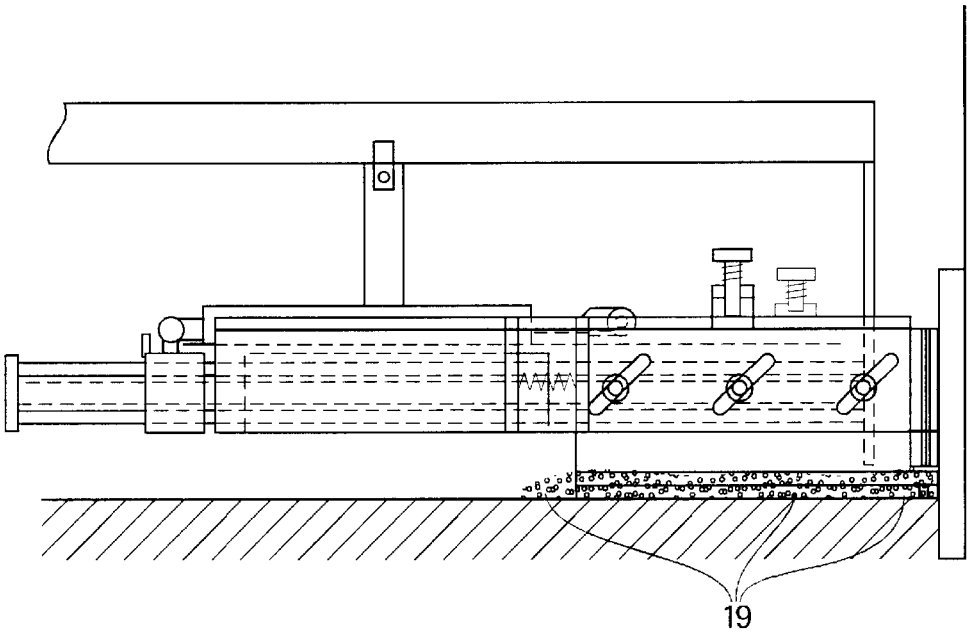
FIG. 3 is the same view as shown in FIG. 2, but showing the planing device while being in contact with the boards.

The planing device always remains mounted and not engaged in conjunction with the inner driving tracks within the inner zone of the planing carriage, and thus is in the idle position. For using the planer, the latter is hydraulically driven into the operating position by actuating a lever from the seat of the driver while the planer is driven to the boards and before it actually comes into contact with the latter. The blade remains subsequently still disengaged and leaves no planing traces on the ice while it is being driven to the boards. The outer side of the blade carrier (6) is defined by a sliding shoe (10). Said sliding shoe (10) is pressed against the base strip (11) of the boards by the drive of the ice processing machine. Due to the lateral pressure applied to the blade carrier (6), the latter with the blade (7) is pressed down up to the lower edge (13) of the skid and thus forced into the engaging position. This is accomplished in that the blade carrier (6) is supported on the planer carrier 5 in a sliding manner by three round bolts, which are guided in the blade carrier (6) in oblong holes set slanted.

The blade carrier (6) is pressed outwards by the force of a spring (8) and the blade (7) is forced out of engagement. By forcing the sliding shoe (10) against the base strip (11) of the boards, the blade carrier (6) is pressed inwards and thus down, and the blade (7) is pushed into the operating position. The limitation of the engagement of the blade on the lower edge (13) of the skid of the planer carriage (12) is adjusted by a setscrew (14).

After the contact with the boards has been released, the function of the blade is automatically terminated. The planer is retracted into the idle position only for optical reasons.

The planer can be extended to an extent such that its function is assured also in the curves of the boards. For allowing the planer to be displaced sideways, the actual planing aggregate is mounted on a sliding rail (2) located on the means (1) for holding the planer. The planing aggregate is displaced by a hydraulic cylinder (20). The base of said hydraulic cylinder is mounted in a sliding manner on a second sliding shoe (3) provided on the sliding rail (2). Said sliding shoe (3) is retained outwards in its basic position by a tension spring (9). The sliding distance of about 15 cm is limited inwards by a stop means (20). Owing to the fact that the hydraulic cylinder (20) is mounted in an elastic manner, and that the planing aggregate, therefore, is consequently driven by the hydraulic cylinder (20) in a flexible way as well, a floating drive of the planer is effected along the boards over the sliding distance of approximately 15 cm. In this way, hard shocks that may be caused by uneven spots on the base of the boards, are absorbed in an elastic manner, so that the ice processing machine needs not to be driven with accuracy down to the millimeter for exactly processing the edge of the ice, but rather may vary by about 15 cm.

For special applications, the planing blade also can be set by means of the setscrew (14) to a position in which it is positioned lower than the skid of the carriage. With the help of a second setscrew (15) it is possible to adjust the depth of engagement of the planing blade as well. Thus planing is possible without problems also without coming into contact with the boards, for example for planing a wider track in the curve, or in front of the open entry and exit gate. For this purpose it is possible to make provision on the outer side of the blade carrier within the sliding shoe for an auxiliary skid, which can be adjusted vertically. Said auxiliary skid prevents the blade from penetrating the ice to any excessive depth. Such drives for making repairs can be dispensed with if the planing device for planing the area of the boards is properly used regularly. Such work operations are required mainly for working ice areas that have grown substantially in thickness by the time the planer for planing the area of the boards is employed for the first time in the middle of the ice-skating season.

Figure 4:
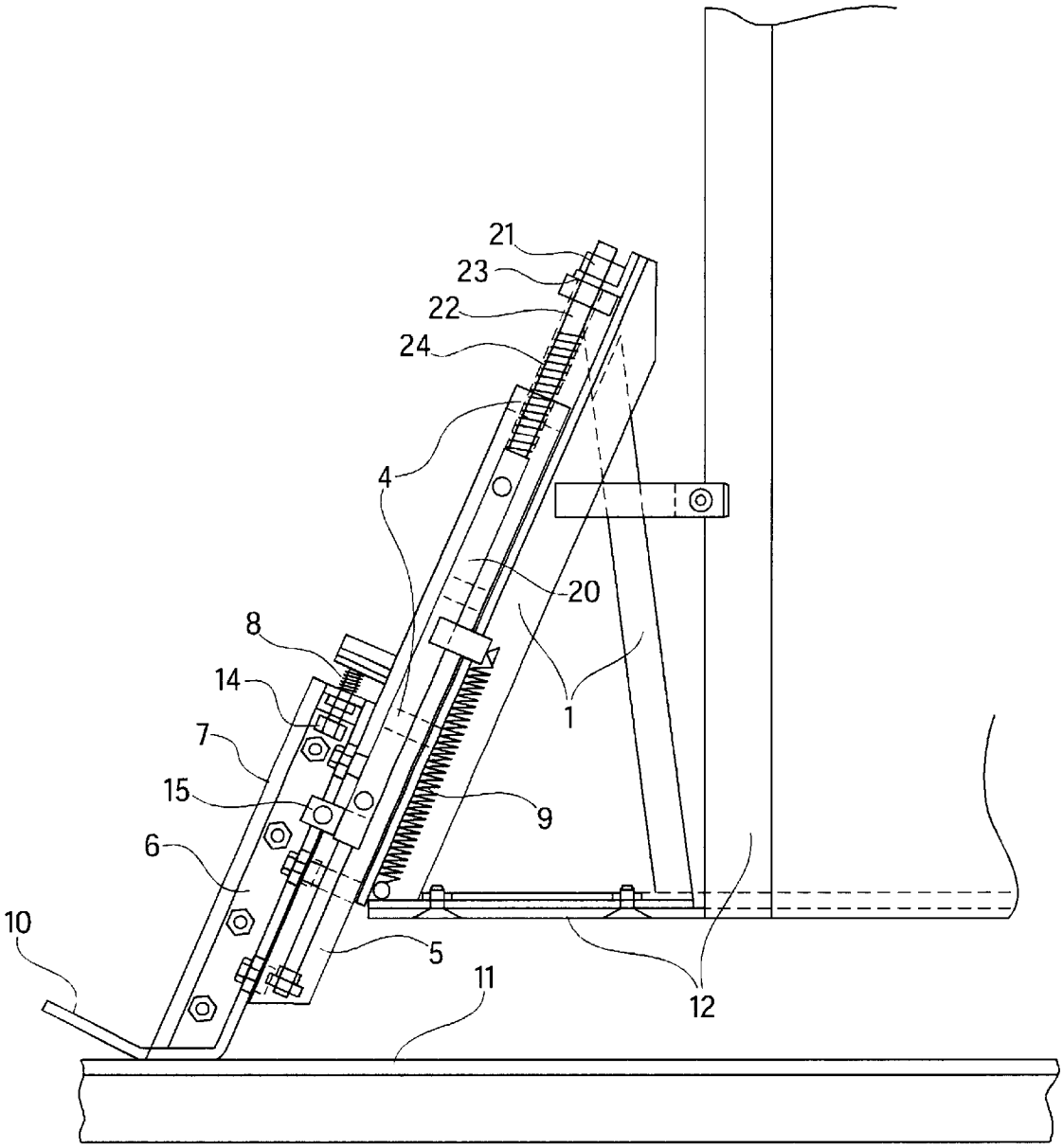
FIG. 4 is an alternative embodiment of a planing device viewed from the top.
Figure 5:
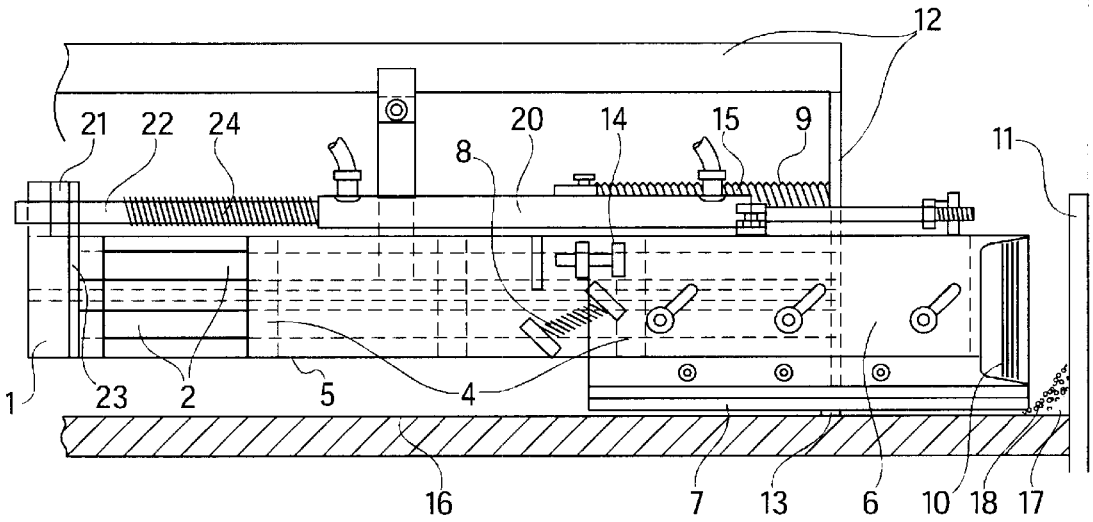
FIG. 5 shows the planing device according to FIG. 4 by a front view without having contact with the boards.
Figure 6:
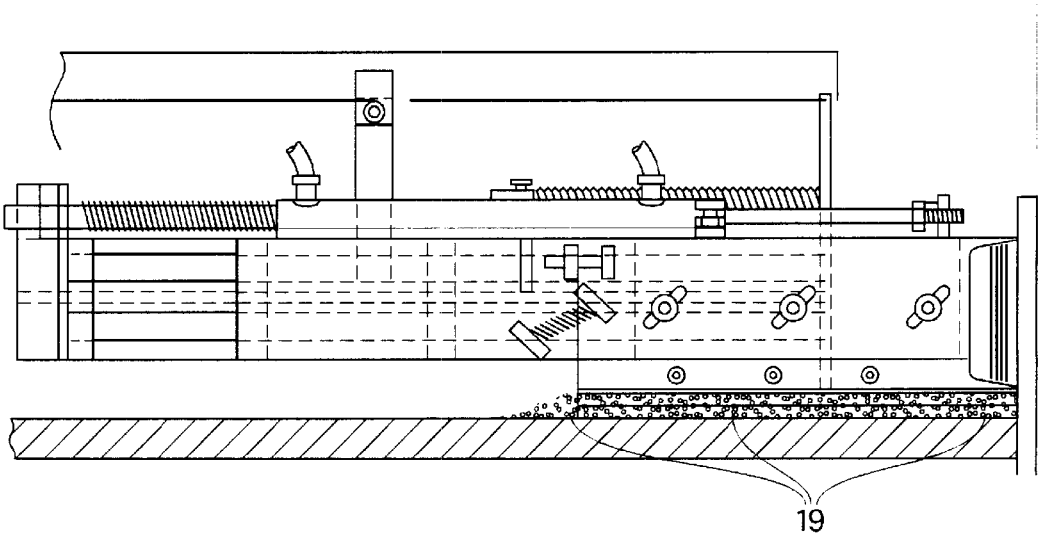
FIG. 6 shows the view according to FIG. 5, but while the planing device is in contact with the boards.

In conjunction with the alternative embodiment according to FIGS. 4 to 6, the planing device is displaced by a hydraulic cylinder (20) as well. The base of said hydraulic cylinder with a double rail (22) is supported in a double sliding bearing (21). The hydraulic cylinder is retained outwardly in its basic position by a tension spring (9). The sliding distance of about 15 cm is limited inwards by a stop means (23). Reference numeral 24 denotes a damping spring. For the purpose of permitting the planer to be displaced sideways, the actual planing device with the planer carrier 5 is guided by means of the two double sliding bearings 21 on the two sliding rails 22, which are mounted on the device 1 holding the planer.

Identical components of the device are provided with identical reference numerals in the drawings.

What is claimed is:

1. A planing device, on an ice processing machine for ice surfaces surrounded by boards, comprising:

a planing carriage coupled to the ice processing machine and having a side wall and a lower edge;

a blade carrier mounted on said side wall of said planing carriage;

a blade coupled to said blade carrier and having a free end;

a driving mechanism coupled to said blade carrier and mounted on said planing carriage;

at least one sliding rail that supports said blade and said driving mechanism in a floating manner;

a tension spring that holds said blade and said driving mechanism out in a basic position on said at least one sliding rail; and a stop means for limiting the movement of said blade and said driving mechanism against the force of said tension spring;

wherein the planing device is applied to an area of the ice surface near the boards, and said lower edge of said planing carriage rests on said ice surface; and wherein said blade is driven from a lifted idle position into a working position by said driving mechanism.

2. The planing device according to claim 1, further comprising a sliding shoe disposed on said free end of said blade, and a spring element, wherein said blade is driven into said working position from said lifted, idle position by a forced guidance means when said sliding shoe is in pressure contact with the boards, and said pressure contact is applied against the force of said spring element.

3. The planing device according to claim 2, wherein said forced guidance means comprises at least two oblong holes in said blade extending in a slanted manner, and guiding bolts coupled to said blade carrier in a fixed manner, wherein said guiding bolts are guided in said oblong holes.

4. The planing device according to claim 2, wherein said forced guidance means comprises at least two oblong holes in said blade carrier extending in a slanted manner, and guiding bolts coupled to said blade, wherein said guiding bolts are guided in said oblong holes.

5. The planing device according to claim 2, wherein said forced guidance means comprises complementary slanted guide means, wherein said guide means are disposed on said blade and said blade carrier.

6. The planing device according to claim 1, wherein said blade is arranged in a slanted position, and said free end is positioned further from said planing carriage than said blade's opposite end.

7. The planing device according to claim 1, wherein said planing carriage and said blade carrier can be laterally displaced toward the boards by said driving mechanism.

8. The planing device according to claim 7, wherein said driving mechanism is a pressure medium cylinder.

9. The planing device according to claim 7, wherein said driving mechanism comprises a spindle with a spindle nut arranged on said spindle.

10. The planing device according to claim 1, wherein said blade and said driving mechanism are supported in a floating manner on two sliding rails.

11. The planing device according to claim 1, wherein said blade penetrates the ice surface to an adjustable maximal depth.

* * * * *